United States Patent [19]

Nakamura

[11] Patent Number: 4,969,196

[45] Date of Patent: Nov. 6, 1990

[54] SPEAKER AND HORN ARRAY

[76] Inventor: Hisatsugu Nakamura, 13-3-1001 Roppongi 5-Chome, Minato-ku, Tokyo, Japan

[21] Appl. No.: 169,741

[22] Filed: Mar. 18, 1988

[30] Foreign Application Priority Data

Mar. 25, 1987 [JP] Japan ..... 62-069087

[51] Int. Cl.[5] ..... H04R 1/28; H04R 1/02; G10K 11/02; G10K 11/22

[52] U.S. Cl. ..... 381/156; 181/152; 181/175; 181/177; 181/187; 181/188; 381/153; 381/154; 381/159; 381/182; 381/188; 381/205

[58] Field of Search ..... 381/156, 153, 154, 159, 381/182, 186, 88, 89, 90, 188, 205; 181/144, 145, 147, 152; 187, 188, 189, 190, 175, 177, 179

[56] References Cited

U.S. PATENT DOCUMENTS

| | | | |
|---|---|---|---|
| 1,684,975 | 9/1928 | Slepian | 181/188 |
| 1,768,226 | 6/1930 | Williams | 181/188 |
| 2,228,886 | 1/1941 | Olson | 381/154 |
| 2,435,535 | 2/1948 | Eaves | 181/188 |
| 3,842,203 | 10/1974 | Weisberg | 381/156 |
| 4,270,023 | 5/1981 | Beveridge | 381/188 |
| 4,344,504 | 8/1982 | Howze | 181/187 |
| 4,553,628 | 11/1985 | Nakamura | 181/199 |
| 4,628,528 | 12/1986 | Bose et al. | 381/154 |

FOREIGN PATENT DOCUMENTS

| | | | |
|---|---|---|---|
| 1030869 | 5/1966 | United Kingdom | 381/90 |
| 461106 | 2/1987 | United Kingdom | 181/187 |

OTHER PUBLICATIONS

Hisatsugu Nakamura, A Vertical Phased Array Speaker System for the Digital Audio Era, AES 3rd Internation Conference, Jun. 21, 1985, p. 139.

Hisatsugu Nakamura et al., Vertical Phased Array Speaker System for AV and PA Applications, AES Conference, Jun. 17, 1987, 4 pages.

*Hi-Fi Loudspeakers and Enclosures,* Abraham B. Cohen, John F. Rider Publisher, Inc., 1956, pp. 165-166 and 265.

*Audio Cyclopedia,* Howard Tremaine, Howard W. Sams and Co., Inc., 1979, p. 1106.

*Primary Examiner*—Jin F. Ng
*Assistant Examiner*—Danita R. Byrd
*Attorney, Agent, or Firm*—Herb Boswell

[57] ABSTRACT

A speaker and horn array having improved audio characteristics is formed in a baffle case. A plurality of small speakers are mounted in the baffle case in a vertical array in close proximity with one another. Each of the speakers has an acoustic baffle over the back of the speaker with an opening located in the baffle. An array of small horns are located in association with the speakers in the baffle case. As with the speakers the horns are also in a vertical array. Each of the horns includes an individual throat, however, all of the horns are joined into a common vertically oriented mouth. The throat of each horn is connected to the opening in the baffle of one of the speakers. This backloads the individual speakers with the common mouth of each of the horns resulting in common backloading of each of the speakers.

15 Claims, 2 Drawing Sheets

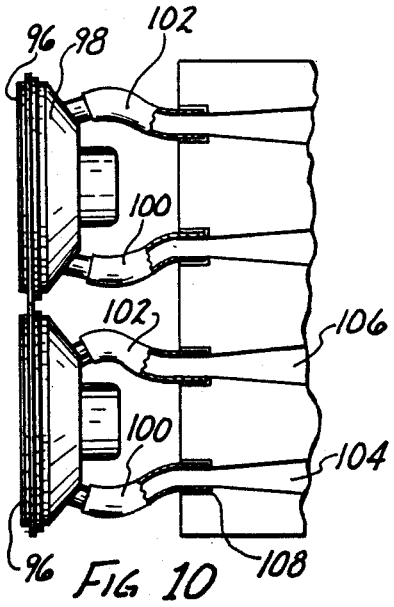
FIG 10
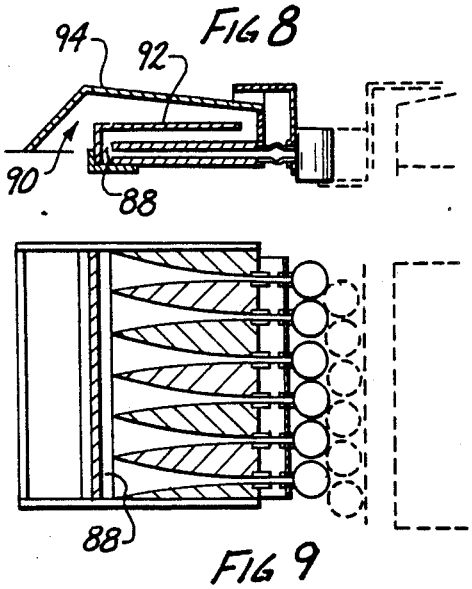
FIG 8
FIG 9
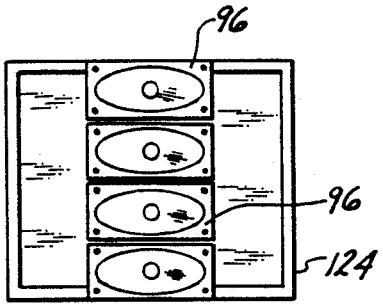
FIG 13
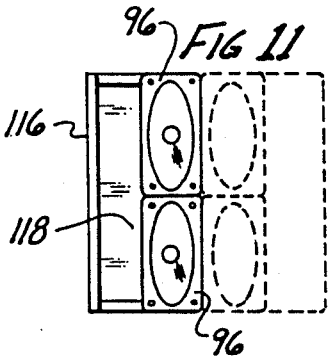
FIG 11
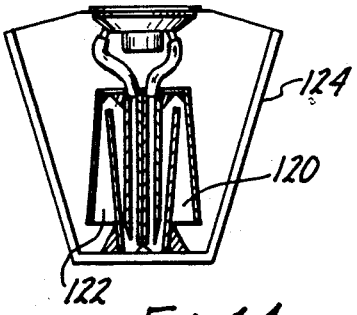
FIG 14
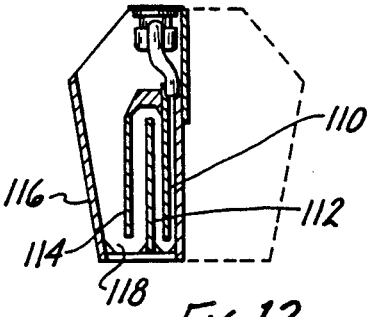
FIG 12

SPEAKER AND HORN ARRAY

BACKGROUND OF THE INVENTION

This invention is directed to a vertical speaker array which is associated with a vertical horn array. Each of the horns share a common vertical mouth and each of the speakers are connected to one of the horns to form common backloading and phasing of the speakers In my prior U.S. Pat. No. 4,553,628, entitled Speaker System, I disclosed a phased array of speakers which can function as a line source for the generation of a wave form having improved directional frequency response with the sound concentrated in a flat pancake like sound field. In the speaker system of my prior patent, a vertical array of speakers are each equipped with an acoustical baffle device on the back side of the diaphragm of each of the speakers. An opening is located in this acoustical baffle device and a flexible tube is attached to the opening. The flexible tubes leading from each of the speakers are then fed to a common resonating chamber which in turn is connected to an acoustic horn. By connecting each of the vertically arrayed speakers to the common resonator chamber each of the speakers is backloaded to the same extent and driven in-phase with each other.

The positioning of the speakers in my device of U.S. Pat. No. 4,553,628 results in the improved directionality of the acoustic wave form emanating from the speaker device and the connection of the acoustical baffles of each of the speakers to a common resonating chamber results in common backloading and phase characteristics of the speakers.

Because the speaker system of my prior U.S. Pat. No. 4,553,628 utilizes a common resonator chamber which leads to an acoustic horn, it was difficult to effectively extend the line source sound wave emanating from this speaker system when placing two or more of these speaker systems in a stacked orientation or side by side. This speaker system, however has improved characteristics compared to simply a stacked array of speakers because it maintains an equal attenuation across a broad spectrum of frequencies at different orientations in a horizontal plane with respect to the axis of the speaker system. That is, when the listener is positioned off axis from the center axis of the speaker system at different orientations as, for instance, 30°, 60° or 90°, little attenuation of the wave form is noticed compared to substantial distortion of the wave forms in a simple stacked speaker array.

While the directivity of a simple stacked array of speakers is inferior to that of the speaker system disclosed in my U.S. Pat. No. 4,553,628 it is, in fact, much better than that achievable with simple point source speakers because of improvements in maintaining the sound waves orientated essentially in a horizontal direction in vertical speaker array versus the overall spreading of the sound waves both horizontal and vertical in a point source speaker.

BRIEF DESCRIPTION OF THE INVENTION

Because of the desirability to be able to extend line source speakers as stacked arrays or as side by side speaker systems, it is a broad object of this invention to provide new and improved speaker devices It is a further object of this invention to provide new and improved speaker devices and processes for forming the same which, while exhibiting improved properties, can be conveniently and consistently formed of a consistent quality at a low cost to the consumer.

These and other objects as will become evident from the remainder of this specification are achieved in a speaker device which includes a baffle case having a plurality of small speakers mounted in a vertical array in close proximity with one another in the baffle case. Each of the speakers has a sound producing diaphragm having a front and rear face. Each of the speakers further includes an acoustical baffle means for receiving sound radiated from the rear face of the speaker. Each of the acoustical baffle means associated with the speaker includes an opening in the baffle means. A plurality of small horns equal in number to the number of the speakers are located in association with the speakers in a further vertical array in the baffle case. Each of the horns has a throat which is connected to the opening in the acoustical baffle means of a speaker. Further each of the horns are connected at a common mouth in the baffle case so as to form a common backloading and phasing of the vertical array of speakers.

The speakers for the speaker device can be chosen as small round speakers having diameters of about 1 to 2 times the wavelength of the highest effective frequency emitted by the speaker or as elongated oval or elongated rectangular shaped speakers which have a width which is essentially also 1 to 2 times the wavelength of the highest effective frequency emitted by the speaker and a dimension along their elongated dimension which is of a multiple of their width. Such elongated speakers can be stacked in a vertical array either with their elongated axis extending along the vertical axis of the array or with their elongated axis extending perpendicular to the vertical axis of the array.

The opening in each of the baffle means associated with the respective speakers can be conveniently attached to the throat of one of the horns utilizing a short length of flexible tubing which extends between the respective opening and the respective horn throat. This allows the vertical height of the stacked array of the speakers to be essentially equal to the vertical height of the stacked horns.

The number of horns can be present in a number equal to the number of speakers such that there is a one to one correspondence of the horns to the speakers, each speaker having one horn attached thereto or the number of horns can be present in multiples of the number of speakers. If a multiple number of horns are utilized for each speaker, a multiple number of openings are provided in the acoustic baffle means associated with each speaker and each of the horns is connected to one of these openings. The multiple horns can be stacked in one vertical array one over the other, or several side by side vertical arrays can be formed. Each vertical array would have each of the horns in the particular vertical array connected together such that they had a common mouth.

In one embodiment the horns have essentially flat vertical interior left and right side walls which extend from the throat of the horns to a common mouth. In this embodiment the horns further have convex curving interior bottom and top walls which extend from the throats of the respective horns to the common mouths. As so formed the left and right interior side walls would extend linearly from the throats of the respective horns to the common mouth and the top and bottom interior walls would extend and expand exponentially from the throats of the respective horns to the common mouth.

Further, in a further embodiment the horns can be formed as a folded horn having parallel upper and lower bottom walls which are joined by side walls. The side walls are spaced apart one from the other at an increasing distance in moving between the throat of the horns to their common mouth.

In a process of using the invention, by locating the horns to have common a mouth for each vertical array of horns and by connecting the speakers via an opening in an acoustical baffle associated with the speakers, each of the speakers can be provided with the same backloadinq and operated in-phase with one another.

BRIEF DESCRIPTION OF THE DRAWINGS

This invention will be better understood when taken in association with the drawings wherein:

FIG. 8 is a top elevational view in section of a flattened speaker and horn array;

FIG. 9 is aside elevational view in partial section of the flattened speaker array of FIG. 8;

FIG. 10 is a side elevational view in partial section showing a dual connection of elongated speakers with a horn assembly;

FIG. 11 is a front elevational view of the speaker array of FIG. 10;

FIG. 12 is a top plan view in section of the speaker array of FIG. 11;

FIG. 13 is a front elevational view of an array of elliptical speakers wherein the major axis of the elliptical shape of the speakers is located perpendicular to the vertical array of the speakers; and FIG. 14 is a top plan in section of the array of FIG. 13.

Figure 1:
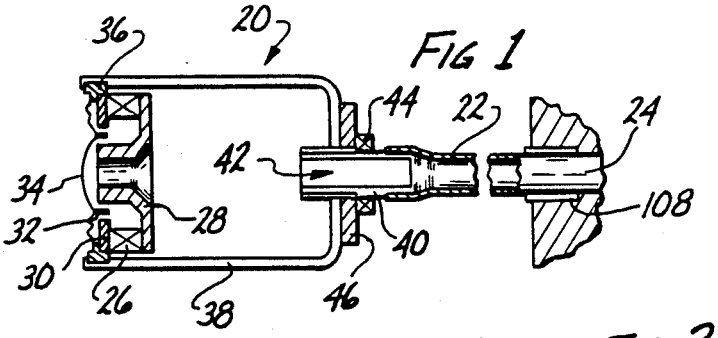
FIG. 1 is an elevational view in section of a speaker and throat of a horn utilized in the invention.

The invention described in this specification and illustrated in the drawings utilizes certain principles and/or concepts as are set forth in the claims appended hereto. Those skilled in the acoustic arts will realize that these principles and/or concepts are capable of being utilized in a variety of embodiments which may differ from exact embodiments utilized for illustrative purposes herein. For this reason this invention is not to be construed as being limited solely to the illustrative embodiments, but should only be construed in view of the claims.

DETAILED DESCRIPTION

A line source speaker array can be formed by stacking a number of speakers one on the other. If the speakers are placed more than a quarter to one half wave length apart in large high power sound systems, then interference between the individual loudspeakers is a major cause of extreme uneven frequency response and erratic radiation patterns. In order to overcome this uneven frequency response and erratic radiation patterns, speakers must be placed adjacent to one another. This physical proximity of the speakers to one another presents problems with respect to backloading the speakers to insure that they correctly operate in-phase with one another. As noted above in my prior U.S. Pat. No. 4,553,628 a closely spaced array of speakers serving as a line source was backloaded by connecting each of the individual speakers to a single resonance chamber and acoustic horn which was positioned below the speaker array.

I have found that by utilizing a plurality of individual horns with at least one individual horn connected to each speaker, the speakers can be commonly backloaded and that stacking and side by side placement of speaker arrays is facilitated.

In the speaker systems of this invention a vertical array of speakers and a vertical array of backloading horns are positioned in association with one another such that a common mouth of the vertical array of the backloading horns spans essentially the same vertical height of the speaker array. Further, this allows for positioning of the speaker array at the front edge of a speaker case which further facilitates stacking and side by side placement of the speaker devices in an infinite variety of speaker lengths and/or widths of speaker array sections and horn sections.

The individual speakers are positioned in a vertical array adjacent to one another to eliminate interference between the speakers. This vertical array can form a line source by selecting the effective diameter for a round or essentially round speakers or an effective short axis for oval or essentially rectangular speakers to be equal to approximately 1 to 2 times the wave length of the highest frequency below which a more or less constant radiation pattern is sought.

Thus, if, for instance, the highest frequency sought was 20 kHz, the effective diameter (or smallest width of an oval or rectangular speaker) would lie between 1.75 cm and 3.5 cm. It has been found that if this diameter is chosen to be from about 2 to about 4 cm a suitable line source can be formed with the vertical array of speakers having consistent radiation patterns over a range of frequencies desirable for good stereo image perception over a large listening area. Typically the speaker system of the invention would be utilized at frequencies of 20,000 kHz down to about 300 Hz.

Further, in order for the speaker array to function as a line source radiation pattern, the diaphragms of each individual speaker must be driven to vibrate in-phase with all of its neighbors. In order to achieve such in-phase motion over a wide range of frequencies the back pressure from each individual speaker must be released under the same loading conditions. In the present invention this is achieved by connecting each individual speaker to one or more small horns which are arranged to have a common mouth or if each speaker is attached to multiple horns, multiple common mouths. Further the individual horns are sized approximately the same. This results in even acoustical backloading and in-phase operation of each of the individual speakers in the speaker array to achieve a line source speaker array.

If elliptical or rectangular speakers are utilized for speaker devices of the invention, they would be chosen such that their short side is essentially in the range given above for round speakers, that is from about 2 to about 4 cm and their longer dimension would be equal to about 2 or 3 times the dimension of the short dimension. With such elliptical or rectangular speakers one or more individual horns would be connected to each speaker as, for instance, each speaker may have two or three horns connected to it. In any event, if a multiple of horns are utilized for each speaker the same multiple of horns would be utilized for each individual speaker such that the acoustical backloading and in-phase operation of the individual speakers is maintained.

In the speaker devices of the invention, each of the individual speakers is provided with an acoustical baffle on the back side of its speaker. The acoustical baffle is positioned around the rear face of the diaphragm of the speaker to contain the acoustical waves emitted from the rear face of the diaphragm of the speaker. Each of these acoustical baffles contain an opening. A short piece of tubing is connected between the opening in the acoustical baffle and the throat of one of the horns of the speaker device. If multiple horns are utilized per each speaker, the same number of multiple openings would be formed in the acoustical baffles and each horn would be individually connected by a short piece of tubing to one of the openings in the acoustical baffle.

The openings in the acoustical baffle conduct the acoustical energy from the rear face of the speaker diaphragm through the short segments of tubing to the horns. By terminating each of the horns in a common mouth (or in multiple common mouths if multiple openings and horns are utilized per each speaker) the back radiation pressure is equalized on each of the speakers on the speaker assembly allowing for in-phase operation of the totality of the speakers.

The speaker array and horn array of the speaker device of the invention are enclosed within an infinite baffle type case which supports and aligns the array of speakers and the array of horns in close proximity to form an acoustical line source of sound. As will be evident when the illustrative embodiments of the invention are described below, this allows for having a speaker array of the same vertical height as are the combined mouths of the horns achieving not only superior performance for the speaker device of the invention, but also allowing for vertical stacking and side by side placement of an infinite variety of the speaker devices of the invention depending upon the particular use of the speaker devices. Because of this the speaker devices of the invention can be utilized in a variety of acoustical settings arranging from placement of stereo speakers on a stereo TV set to large amphitheater type situations requiring large power and acoustical outputs.

The coupling of each of the speakers in the array of speakers with an individual horn or a multiple of individual horns can be achieved with several different horn constructions. In one construction the horns are formed having parallel or converging side walls which are joined by upper and lower walls which are convexly curved from the interior of the horn. All of these walls extend from a throat of the horn to a horn mouth. As so constructed this will allow for joining of the horns in a common mouth. If the mouths of each of the individual horns where they join the common mouth are of approximately the same dimension as the dimensions of the speaker than the common mouth of the horn can be made to have approximately the same vertical dimension as the vertical dimension of the speaker of the array of individual speakers. As so constructed these horns, when viewed from the mouth of the horns, are formed essentially as a vertical slot shaped horn. The side walls of these horns provide for linear expansion from the horn throat to the horn mouth whereas the top and bottom wall provide for exponential expansion from the horn throat to the horn mouth.

In a further construction the horns can be formed as folded horns These folded horns would have one or more folded sections formed by parallel top and bottom walls which are connected by side walls which flare outwardly from one another in moving from the horn throat to the horn mouth. As so constructed the side walls would flare at each fold in the horn with the expansion rate at each succeeding fold going from the throat to the mouth expanding at a higher rate than the expansion rate of previous folds.

For each of the types of horns described above, equal acoustical backloading would be applied to the diaphragm of each speaker in the speaker array to achieve an essential constant acoustical backloading on the totality of the speakers in the array to assure in-phase motion of each of the diaphragms of the speakers of the array.

As so constructed the speaker devices of the invention achieve a line source cylindrical wave front. This line source cylindrical wave front can be vertically extended by stacking speaker devices of the invention one upon the other. The equalization of the vertical height of the speaker array and the vertical height of the common horn mouth provides for a virtual extension of the cylindrical wave front line source while maintaining in-phase operation of each of the stacked speaker arrays.

Reference is made to my above referred to U.S. Pat. No. 4,553,628 with respect to the construction of speakers having acoustical baffle devices on the back of the speakers. For this reason the entire contents of that patent are herein incorporated by reference. In FIG. 1 a slightly different acoustical baffle is utilized compared to the acoustical baffle described in U.S. 4,553,628. In FIG. 1 a speaker and acoustical baffle unit 20 is shown attached via a small section of flexible tubing 22 to the throat area 24 of a horn. The speaker utilized in the speaker and baffle unit 20 is of a moving voice coil type however, other speaker types such as electrostatic or condenser type speakers could be utilized.

As shown in FIG. 1 a ring shaped permanent magnet 26 is positioned between a center pole plate 28 and an outer pole plate 30. This forms an annular gap between the central pole plate 28 and the outer pole plate 30 having a high density magnetic field. A voice coil 32 is attached to a diaphragm 34. THe diaphragm 34 in turn is supported by a ring 36 in an acoustical baffle 38. This centers the voice coil 32 in the gap between the center pole plate 28 and the outer pole plate 30 whereby the voice coil 32 and the diaphragm 34 vibrate as a piston in-phase across the totality of the surface of the diaphragm 34. That is, the diaphragm vibrates without break up across the totality of its surface.

A nipple 40 is appropriately connected in an opening 42 in the acoustical baffle 38 by welding, swaging, forming or other suitable means. A nut 44 screws over the nipple 40 to attach the speaker and baffle unit 20 an appropriate support 46. As so constructed the speaker and baffle unit 20 of the invention has an effective diameter just slightly greater than the effective diameter of its diaphragm. Further, as so constructed and mounted individual speaker and baffle units 20 of the invention can be positioned in close proximity to one another in arrays.

Except as specifically noted below in discussing the use of elliptical or oval speakers each of the speakers in the individual speaker devices shown in the figures is identical to the speaker 20 and would be appropriately supported in a support structure 46. For this reason like numerals will be utilized to identify these and other common components utilized in the various speaker devices described.

Figure 2:
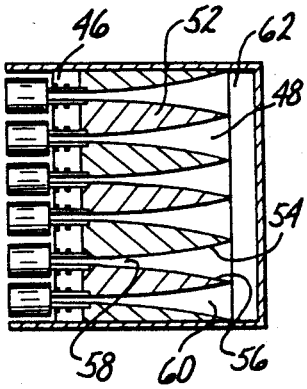
FIG. 2 is a side elevational view in partial section of a vertical array of speakers and horn assemblies.
Figure 3:
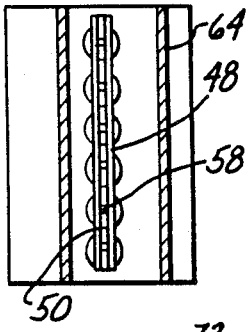
FIG. 3 is an end elevational view of the speaker and horn assembly of FIG. 2.

FIGS. 2 and 3 show a side elevational view and a rear elevational view of a single array of the speaker and baffle units 20 in conjunction with a first horn construction. A plurality of individual horns are formed in part by common side walls 48 and 50. These are positioned flat and essentially parallel to one another. Located between the side walls 50 in association with each of the individual speaker and baffle units 20 is a spacer element 52. As can be seen in FIG. 2 in side view the spacer element 52 between individual speaker and baffle units 20 is somewhat projectile in shape and for the top and bottom most individual speaker unit 20 is essentially formed as one half of a projectile type shape.

The spacer elements 52 form convex shaped top and bottom walls 54 and 56 of individual horns. These top and bottom walls 54 and 56 curve outwardly away from one another in moving from the throat area 58 to the mouth area 60 of the individual horns. The mouth areas 60 of the individual horns are joined in common to a common mouth 62. The individual horn throats 24 formed at the throat area 58 are then joined as described above utilizing the flexible tubing 22 to the individual speaker and baffle units 20.

As is evident from viewing FIGS. 2 and 3 each of the individual speaker and baffle units 20 is connected to its own individual horn. The individual horns, however, in turn share a common mouth 62. The vertical dimension of the common mouth 62 is essentially the same as the vertical dimension of the stacked array of the individual speaker and baffle units 20.

Figure 4:
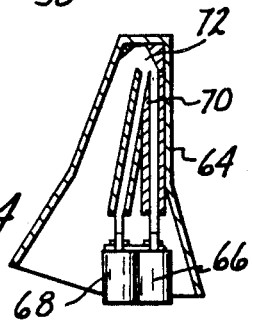
FIG. 4 is a top plan view in section of a dual array of speakers and horns within a baffle case.
Figure 5:
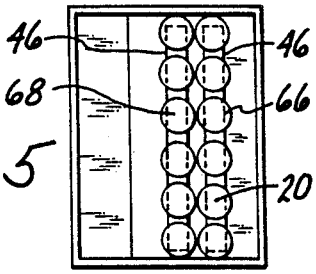
FIG. 5 is a front elevational view of the dual array of FIG. 4.

The individual speakers and horns of FIGS. 2 and 3 are positioned within an infinite baffle case 64. This same baffle case 64 is illustrated in FIGS. 4 and 5 for a different arrangement of speakers and horns. In any event, irrespective of the arrangement of speakers and horns within the infinite baffle case 64 it allows for positioning of a vertical array of speakers and a like vertical array of horns having essentially the same vertical height in an enclosure providing for equal acoustical back pressure for each of the speakers in the speaker array and thus in-phase operation of each of these speakers with one another.

In FIGS. 4 and 5 two arrays of speakers and horns as per those described in FIGS. 2 and 3 are utilized in a single infinite baffle case 64. In FIGS. 4 and 5 a first array 66 is positioned adjacent to a second array 68. The same type of horns as are illustrated in FIGS. 2 and 3 are utilized with the exception that the side walls at 70 of the two horns are planed to fit adjacent to one another such that the horns of the array 66 and the array 68 have a common mouth shown at 72.

Figure 7:
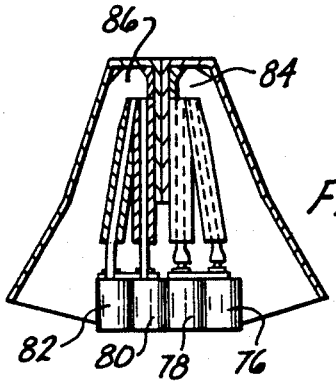
FIG. 7 is a top plan view in partial section of the quad speaker array of FIG. 6.
Figure 6:
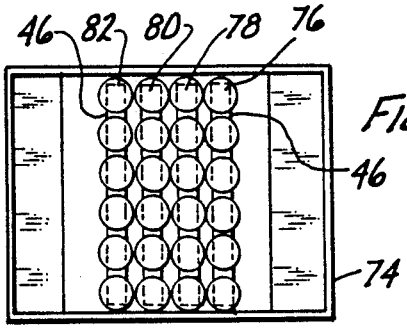
FIG. 6 is a front elevational view of a quad array of speakers and horns in a baffle case.

In a like manner in FIGS. 6 and 7 a quad array of speakers and horns is illustrated. In FIGS. 6 and 7 the quad array is located in an infinite baffle case 74 with first and second speaker and horn arrays 76 and 78 sharing a common mouth at 84 and second and third speaker and horn arrays 80 and 82 sharing a common mouth at 86 with both the common mouths 84 and 86 positioned within the interior of the infinite baffle case 74 such that there is equal backloading and thus in-phase operation of the diaphragms of each of the speakers in the arrays 76, 78, 80 and 82.

The speaker device of FIGS. 8 and 9 is similar to that of previous embodiment except that in these figures, the openings in the acoustical baffles 38 are placed in the sides of the acoustical baffles and not in the rear of the acoustical baffle. This allows for positioning of a horned array to one side or the other of the speakers. Further the horn array, constructed as per FIGS. 2 and 3 above, has its common mouth 88 located in the throat of a folded horn 90. The folded horn 90 is formed by wall 92 which is positioned so as to flare slightly with respect to the speaker horn. Wall 94 in turn is positioned to flare slightly with respect to the wall 92. As sound thus travels through the folded horn 90 the sound chamber gradually expands because of the positioning of the walls 92 and 94 with respect to each other and with respect to the small horn attached to each of the speakers.

As is evident from FIGS. 8 and 9 the speaker devices of these figures would be particularly suited for placement on a flat vertical surface as, for instance in a small apartment, in a vehicle or the like where space is of a premium.

FIGS. 10, 11 and 12 illustrate the use of elliptical or oval speakers 96 in conjunction with connecting more than one individual horns to each of the speakers. In FIGS. 10 and 11 the oval speakers 96 are oriented such that their elongated axis, i.e. their major elliptical axis, is positioned to coincide or be colinear with the vertical axis of the array. In FIGS. 13 and 14 the speakers 96 are positioned such that their elongated or major elliptical axis is perpendicular to the vertical axis of the array.

Each of the speakers 96 includes an acoustical baffle 98 on its rear face. Two openings are located in the acoustical baffle 98 such that two tubing segments 100 and 102 lead from each of the speakers 96. Tubing segment 100 leads to the throat of a first horn 104 associated with the speaker 96 and tubing 102 leads to the throat of a second horn 106 associated with the speaker 96. Attachment of the tubings 100 and 102 to the horns 104 and 106 can be facilitated by incorporating a small metal bushing 108 in the throat of each of the respective horns and positioning the tubing 100 or 102 within the bushing 108.

While, for illustrative purposes, in FIGS. 10 through 12 each of the speakers 96 is connected to two horns, that is each of the speakers is served by two horns. It is evident that one or more additional horns could also be connected to each speaker, thus each speaker would be served by three, four or more individual horns. Each speaker in the individual speaker array, however, would be connected to a balanced number of horns such that the acoustical backloading to each speaker is equal to insure in-phase operation of the totality of all of the speakers.

In FIG. 11 for the speakers which are arrayed with their major elliptical axis along the vertical, the two individual horns connected to each speaker are stacked one on top of the other. Each of the individual horns is formed as a folded horn utilizing walls 110, 112 and 114. The wall 112 is inclined with respect to the wall 110 and the wall 114 is further inclined with respect to the wall 112 and to the infinite baffle case 116 to form a folding horn having an increasing dimension as sound propagates through the horn to the common mouth 118 of the folded horn.

In FIGS. 13 and 14 the speaker 96 is connected to two side by side folded horns 120 and 122 constructed as per the folded horns of FIG. 11. Since the mouths of both of the horns 120 and 122 are located within the infinite baffle case 124 they share common acoustical backloading and thus assure in-phase operation.

As is evident from the phantom lines shown in FIGS. 11 and 12 the use of elliptical speakers which are vertically stacked along the major axis of the ellipse allows for side by side placement of both a left and right speaker or if desired these two speakers could be separated and positioned on the sides of a further electrical device, as for instance on the sides of a stereo TV.

The embodiment of FIGS. 13 and 14 is particularly suited for public address systems and other large speaker assemblies, as for instance concert halls and the like. This particular arrangement provides for a large power capacity and therefore excellent coverage while at the same time allowing for stacking of the speakers to extend the line source array. It is also evident that the speaker devices of FIGS. 11 and 12 can also be stacked to extend the line source array.

What is claimed is:

1. A speaker device which comprises:

a baffle case having an interior;

a plurality of small speakers mounted in a vertical array in close proximity to one another in said baffle case, each of said speakers including a diaphragm having a front and a rear face, said front face of said diaphragm directly opening to the ambient for radiating sound;

a plurality of acoustical baffle means each for receiving sound radiated from the rear face of a speaker, the number of said acoustical baffle means equal in number to the number of said speakers with one of said acoustical baffle means acoustically connected to the rear face of each of said respective speakers, each of said acoustical baffle means including an opening;

a plurality of small horns equal to the number of said speakers such that one of said horns is associated with each of said speakers, each of said horns having a throat connected to said opening of the one of said acoustical baffle means with which said horn is associated, said plurality of horns vertically stacked one on the other in said interior of said baffle case and physically joined at a common mouth in said interior of said baffle case;

each of said speakers being connected to its respective horn by a short length of flexible tubing extending between the opening in the respective acoustical baffle means and the throat of the respective horn;

the vertical height of said stacked array of speakers being essentially equal to the vertical height of said stacked horns; and each of said horns having left and right essentially flat vertical interior side walls which extend from the throats of said respective horns to said common mouth and further each of said horns having convex curing interior bottom and top walls which extend from the throats of said respective horns to said common mouth.

2. A speaker device of claim 1 wherein:

said speakers are essentially round and of essentially the same diameter with said diameter being 1 to 2 times the wavelength of the highest effective frequency emitted by said speakers.

3. A speaker device of claim 1 wherein:

said speakers are of a shape selected as one of an essentially elongated oval shape and a rectangular shape and are of essentially the same size and where the dimension of each of said speakers perpendicular to their elongated axis is essentially 1 to 2 times the wavelength of the highest effective frequency emitted by said speakers and the dimension along their elongated dimension is a multiple of the perpendicular dimension.

4. A speaker device of claim 3 wherein:

said speakers are stacked in a vertical array with their elongated axis extending axially with the vertical axis of the vertical array.

5. A speaker device of claim 3 wherein:

said speakers are stacked in a vertical array with their elongated axis extending perpendicular with the vertical axis of the vertical array.

6. A speaker device of claim 1 wherein:

the dimension of the left and right side walls of each of said horns where said side walls join said common mouth is of a dimension essentially equal to the vertical dimension of the speaker with which the horn is associated.

7. A speaker device which comprises:

a baffle case having an interior;

a plurality of small speakers mounted in a vertical array in close proximity to one another in said baffle case, each of said speakers including a diaphragm having a front and a rear face;

a plurality of acoustical baffle means each for receiving sound radiated from the rear face of a speaker, the number of said acoustical baffle means equal in number to the number of said speakers with one of said acoustical baffle means acoustically connected to the rear face of each of said respective speakers, each of said acoustical baffle means including an opening;

a plurality of small horns equal to the number of said speakers such that one of said horns is associated with each of said speakers, each of said horns having a throat connected to said opening of the one of said acoustical with which said horn is associated, said plurality of horns vertically stacked one on the other in said baffle case and physically joined at a common mouth in said interior of said baffle case; and each of said speakers being connected to its respective horn by a short length of flexible tubing extending between the opening in the respective acoustical baffle means and the throat of the respective horn.

8. A speaker of claim 7 wherein:

each of said baffle means includes a multiple number of openings;

said plurality of small horns being present in a number equal to the number of said speakers times the number of said multiple openings in each of said baffle means such that a multiple of said horns equal to the number of said openings in each of said baffle means are associated with each of said speakers, each of said horns having a throat connected to one of the openings of the one of said baffle means with which said respective horn is associated; and said plurality of horns vertically stacked one on the other in said baffle case in a multiple of stacked arrays with the number or said stacked arrays equal to the number of said openings in each of said baffle means and with the members of each stacked array joined at a common mouth in said baffle case.

9. A speaker device of claim 7 wherein:

said vertical height of said stacked array of speakers is essentially equal to the vertical height of the stacked horns.

10. A speaker device of claim 7 wherein:

each of said horns has left and right vertical interior side walls which extend and expand linearly from the throats of said respective horns to said common mouth and further each of said horns has bottom and top interior walls which extend and expand exponentially from the throats of said respective horns to said common mouth.

11. A speaker device which comprises:

a baffle case having an interior;

a plurality of small speakers mounted in a vertical array in close proximity to one another in said baffle case, each of said speakers including a diaphragm having a front and a rear face;

a plurality of acoustical baffle means each for receiving sound radiated from the rear face of a speaker, the number of said acoustical baffle means equal in number to the number of said speakers with one of said acoustical baffle means acoustically connected to the rear face of each of said respective speakers, each of said acoustical baffle means including an opening;

a plurality of small horns equal to the number of said speakers such that one of said horns is associated with each of said acoustical baffle means, each of said horns having a throat connected to said opening of the one of said speakers with which said horn is associated, said plurality of horns vertically stacked one on the other in said baffle case and physically joined at a common mouth in said interior of said baffle case; and each of said horns being formed as a folded horn having parallel upper and lower walls which are joined by side walls and wherein said side walls are spaced apart from one another at an increasing distance in moving between said throat of said horn and said common mouth.

12. A process of forming a speaker device which comprises:

selecting a baffle case;

selecting a plurality of small speakers each having an acoustical baffle attached to the back side of the small speakers;

locating an opening in each of said acoustical baffles;

mounting said plurality of small speakers with said baffles attached thereto in a vertical array in said baffle case;

selecting a plurality of small horns equal in number to the number of said small speakers, each of said horns having a throat;

mounting said small horns in a vertical array in said baffle case in association with said small speakers, said horns mounted in said baffle case so as to have a common mouth;

forming each of said horns as a folded horn having parallel upper and lower walls which are joined by side walls and wherein said side walls are spaced apart from one another at an increasing distance in moving between said throat of said horn and said common mouth;

connecting the throat of a respective one of said horns to the opening in a respective one of said speaker baffles to backload the respective speaker connected to the respective speaker baffle; and operating said speakers in unison to provide substantially equal backloading pressure to each of said speakers by virtue of said horns all being connected to said common mouth.

13. A process of claim 12 including:

locating a multiple number of openings in each of said acoustical baffles;

selecting said plurality of small horns as a number equal to the number of said speakers times the number of said multiple openings in each of said acoustical baffles;

associating with each of said speakers a multiple of horns equal to the number of said openings in said acoustical baffles;

connecting the throat of each of said horns to one of the openings in the one of said acoustical baffles with which said respective horn is associated; and stacking said plurality of horns vertically one on the other in said baffle case in a multiple of stacked arrays with the number of said stacked arrays being equal to the number of said openings in each of said acoustical baffles and with the members of each stacked array joined at a common mouth in said baffle case.

14. A process of claim 12 including:

selecting said speakers as essentially round speakers each having a diameter 1 to 2 times the wavelength of the highest effective frequency emitted by said speakers.

15. A process of claim 12 including:

selecting said speakers as one of an essentially elongated oval shape and a rectangular shape and of essentially the same size and where the dimension of each of said speakers perpendicular to their elongated axis is essentially 1 to 2 times the wavelength of the highest effective frequency emitted by said speakers and the dimension along their elongated dimension is a multiple of the perpendicular dimension.

* * * * *